US006688736B1

(12) United States Patent
Tunmore et al.

(10) Patent No.: US 6,688,736 B1
(45) Date of Patent: Feb. 10, 2004

(54) WICKING ARRANGEMENT TO ELIMINATE CATCHER DRIPPING

(75) Inventors: David F. Tunmore, Xenia, OH (US); David A. Huliba, Centerville, OH (US); Bruce A. Bowling, Beavercreek, OH (US); Robert J. Simon, Bellbrook, OH (US)

(73) Assignee: Scitex Digital Printing, Inc., Dayton, OH (US)

( * ) Notice: Subject to any disclaimer, the term of this patent is extended or adjusted under 35 U.S.C. 154(b) by 0 days.

(21) Appl. No.: 10/254,323

(22) Filed: Sep. 25, 2002

(51) Int. Cl.[7] ..... B41J 2/185; B41J 2/165
(52) U.S. Cl. ..... 347/90; 347/30; 347/31
(58) Field of Search ..... 347/90, 30, 31

(56) References Cited

U.S. PATENT DOCUMENTS 6,247,781 B1 * 6/2001 Blum ..... 347/29

FOREIGN PATENT DOCUMENTS

EP 1013439 A2 * 6/2000 ..... B41J/2/17

* cited by examiner

*Primary Examiner*—Thinh Nguyen
(74) *Attorney, Agent, or Firm*—Barbara Joan Haushalter

(57) ABSTRACT

An inkjet printer has a catcher and eyelid seal for sealing against the catcher during startup and shutdown. A wicking means is provided for removing excess ink from a fluid channel of the catcher having an associated catcher plate, in an area of the eyelid seal. The wicking means is positioned in an area at a bottom surface of the fluid channel, without bridging a height of the fluid channel, above the catcher plate, and in close proximity to the eyelid seal, while maintaining a consistent pressure at an entrance to the fluid channel.

17 Claims, 3 Drawing Sheets

WICKING ARRANGEMENT TO ELIMINATE CATCHER DRIPPING

TECHNICAL FIELD

The present invention relates to continuous ink jet printing and, more particularly, to preventing ink from dripping following a startup sequence for a continuous ink jet printhead, when the eyelid opens to the print position.

BACKGROUND ART

Ink jet printing systems are known in which a printhead defines one or more rows of orifices which receive an electrically conductive recording fluid from a pressurized fluid supply manifold and eject the fluid in rows of parallel streams. Printers using such printheads accomplish graphic reproduction by selectively charging and deflecting the drops in each of the streams and depositing at least some of the drops on a print receiving medium, while others of the drops strike a drop catcher device.

In normal operation of the printhead, the charging electrodes deflect most of the ink drops, causing them to strike the catcher face. The ink then flows down the catcher face and enters the catcher throat. Vacuum then draws the ink through the catcher outlet port back to the ink reservoir.

Ink removal means have been applied in the ink jet printing field, such as by the use of screens in catchers, for example, in U.S. Pat. No. 5,105,205, and U.S. Pat. No. 5,469,202. In the prior art, screens have been used to fill the front of the catcher throat or fluid channel. A portion of those folded screens lies on the bottom surface of the catcher flow channel, and bridges the gap to the upper surface of the fluid channel. In that position, all the ink must flow through the pores of the screen to enter the catcher flow channel. The flow of the ink through the pores of the screen produces a significant pressure drop through the screen. The pressure drop through the screen, in combination with the unobstructed flow channel behind the screen, serves the stated purpose in the prior art of providing uniform ink removal across the width of the flow channel.

During the automatic startup sequence of a continuous ink jet printhead, the fluid pressure to the ink jets can be anywhere from a low pressure where ink "weeps" from the droplet generator to the final operating pressure. By way of example, for some printheads, the startup sequence can include states where ink weeps at low pressure from the droplet generator, to help redissolve ink on the exterior of the orifice plate and on the charging electrodes; states where ink is jetted out of the droplet generator orifices at a pressure lower than the operating pressure to allow condensate cleaning and drying of the charge plate; and states where the ink pressure is at the operating pressure, prior to turning on the drop charging to deflect the droplets onto the catcher face.

During the startup sequence, eyelid means are used to seal against the bottom of the catcher. The eyelid sealing means not only seal against the catcher, but are also designed to divert ink that is jetting from the drop generator into the catcher throat. It has been determined that this process of diverting ink flow into the catcher throat by means of the eyelid has much higher fluid flow energy losses than the process of having the ink drops strike the catcher face and then flow into the catcher throat. As a result, a catcher ink return geometry that can effectively remove ink from the printhead when the drops are deflected into catch may have too much restriction to remove ink that is diverted into the catcher throat by the eyelid. In particular, it has been noted that while screens can be employed in the catcher throat for certain short array printhead configurations, that they produce excessive flow impedance for proper operation of longer array printheads having higher flow rates. For such systems, a fluid return geometry as described in U.S. Pat. No. 6,187,212 has been found to be more effective.

The flow rate of ink in ink jet printheads developed since the development of the '212 flow geometry have increased from 750 ml/min to 1300 ml/min. Small changes in the flow geometry in keeping with the teachings of the '212 patent have allowed the flow return channel to handle the increased flow rates. However, it has been found that while the flow return channels can handle the ink both during startup and when in catch, during the transition into catch enough ink remains at the front of the flow return channel in contact with the eyelid seal, to drip and to bridge the opening between the eyelid seal and the catch plate edge. Even when this ink bridge is removed manually, closing the eyelid and then reopening it would cause ink to pull out from the catcher throat.

It would be desirable, therefore, to be able to remove excess fluid that can remain on the eyelid seal at or near the catch plate edge after the ready startup cycle of a printhead, particularly for high flow rate printheads, without introducing a pressure drop at the entrance to the catcher fluid channel.

SUMMARY OF THE INVENTION

An appropriately placed wicking medium, in combination with surface tension, solves the problem of excess fluid remaining on the eyelid seal. During the ready startup sequence of certain printheads, particularly printheads having high flow rates, the transition of jetting into the catch plate and the eyelid seal to the application of a charge potential for deflecting the droplets onto the catcher surface at the eyelid seal, can cause ink to be left on the eyelid seal, which ink drips after the eyelid is opened to the print position. In accordance with the present invention, a stainless steel mesh screen is placed on the catch plate of the printhead assembly to eliminate the ink on the seal, and to keep the ink away from the catch plate edge to eliminate ink pullout.

In accordance with one aspect of the present invention, an inkjet printer has a catcher and eyelid seal for sealing against the catcher during startup and shutdown. A wicking means is provided for removing excess ink from a fluid channel of the catcher having an associated catcher plate, in an area of the eyelid seal. The wicking means is positioned in an area at a bottom surface of the fluid channel, without bridging a height of the fluid channel, above the catcher plate, and in close proximity to the eyelid seal, while maintaining a consistent pressure at an entrance to the fluid channel.

Other objects and advantages of the invention will be apparent from the following description, the accompanying drawings and the appended claims.

DETAILED DESCRIPTION OF THE PREFERRED EMBODIMENTS

After the startup sequence has been completed for certain high flow rate continuous ink jet printheads, the eyelid is opened to the print position to allow printed droplets to fall to the moving print substrate. However, when the eyelid is opened, in the absence of the present invention, ink can bridge the opening between the eyelid seal and the catch plate edge, causing dripping and blocking the path of the print drops. Although the ink can simply be wiped away, the problem reoccurs each time the eyelid is closed and then reopened to the print position. In accordance with the present invention, therefore, a wicking device or arrangement is incorporated into the fluid channel to eliminate excess ink at the eyelid seal.

Figure 1:
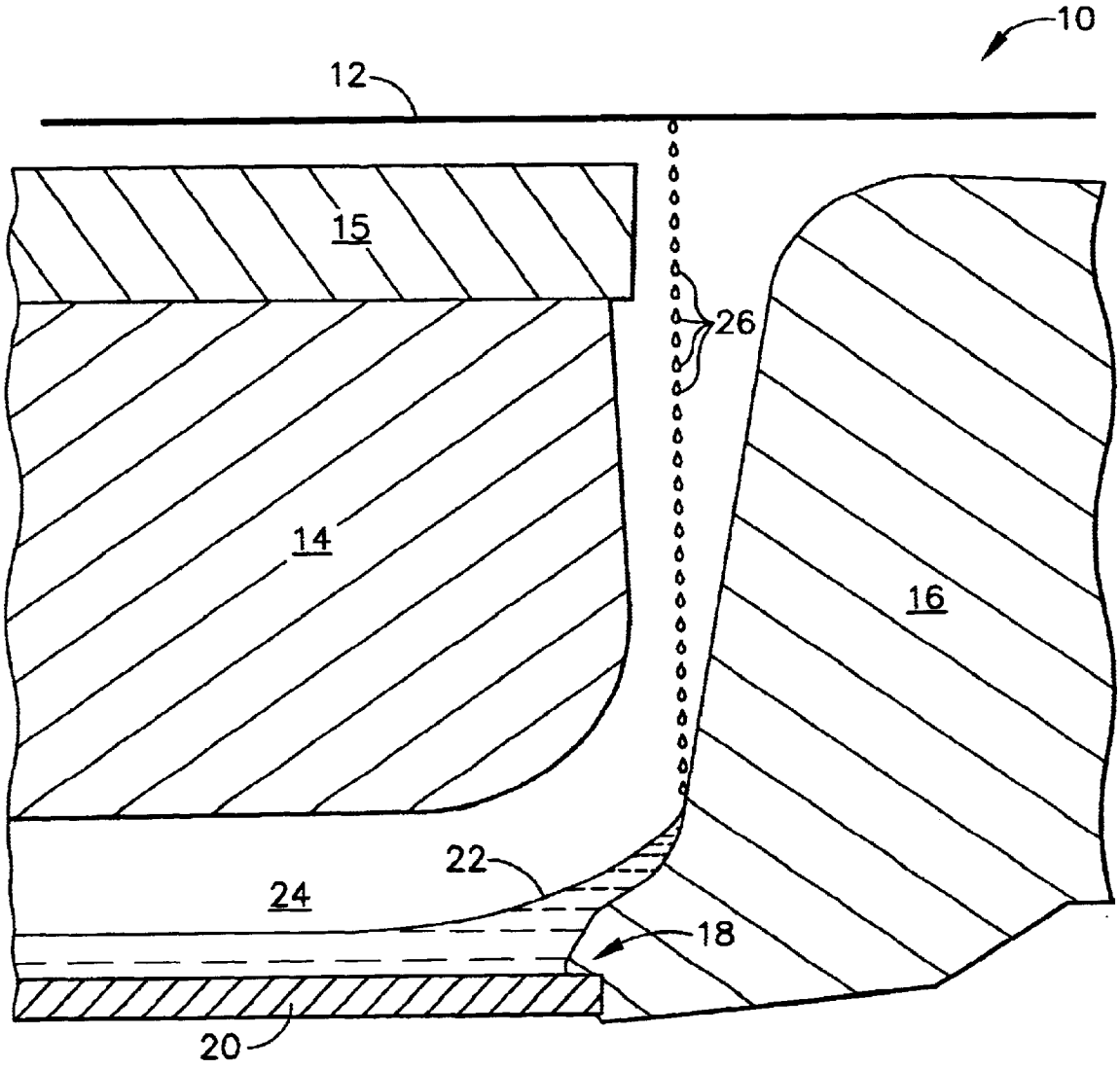
FIG. 1 is a prior art side view of a printhead, illustrating the trajectory flow of uncharged ink droplets, diverted by the eyelid into the catcher fluid channel, as is done during startup.

In FIG. 1, there is illustrated a prior art view of a drop generator and catcher assembly 10. A drop generator 12 is situated in an area above a catcher 14 and charge plate 15, and an eyelid 16. When the eyelid is in the open position, ink drops are allowed to exit the printhead. When the eyelid is moved to the closed position, as shown in FIG. 1, the eyelid seal 18 presses against the bottom edge of the catcher plate 20 to contain ink 22 within the printhead on startup and shutdown of the printer system. The uncharged ink droplets flow along a trajectory path indicated by 26 in FIG. 1. The ink striking the eyelid 16 is diverted by the eyelid into the fluid channel 24 of the catcher. This ink flow through the fluid channel is primarily along the lower surface of the fluid channel, defined by the catcher plate 20.

Figure 2:
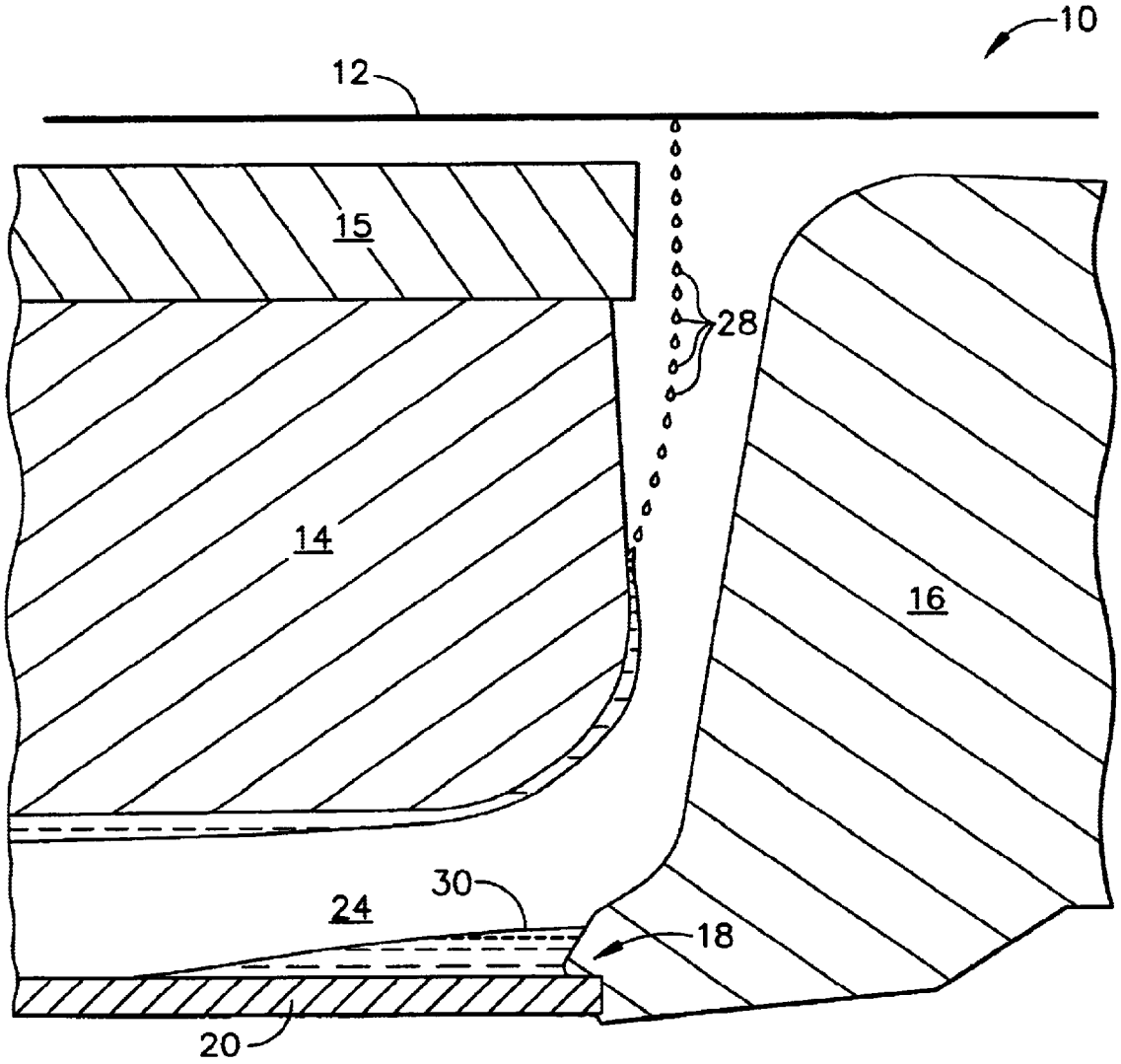
FIG. 2 (PRIOR ART)
FIG. 2 is a prior art side view of the printhead, illustrating ink charged and deflected into catch, as is done near the end of the startup cycle.

Upon startup, the ink drops become charged, changing the trajectory path of the droplets as indicated by 28 in FIG. 2. The ink drops strike the face of the catcher 14 and flow down the face of the catcher, around the catcher radius 27, and into the fluid channel 24 of the catcher. The fluid flow through the fluid channel under these conditions is primarily along the upper surface of the fluid channel, defined by the surface of the catcher. During the transition in flow from primarily along the bottom of the fluid channel to primarily along the top of the fluid channel, some ink 30 can remain pooled on the bottom of the fluid channel. In many cases, this pooled ink remains on the catcher plate 20 near or in contact with the eyelid seal. This pooled ink 30 will clearly drip through the opening created when the eyelid seal is opened. There can even be enough ink pooled to bridge the opening between the eyelid seal and the catch plate edge. The pooled ink 30 is actually held in place by surface tension. Hence, when the eyelid seal is closed, it contacts the ink pool 30, breaking the surface tension and causing the ink to be pulled off the catch plate, thereby leading to undesirable dripping.

Figure 3:
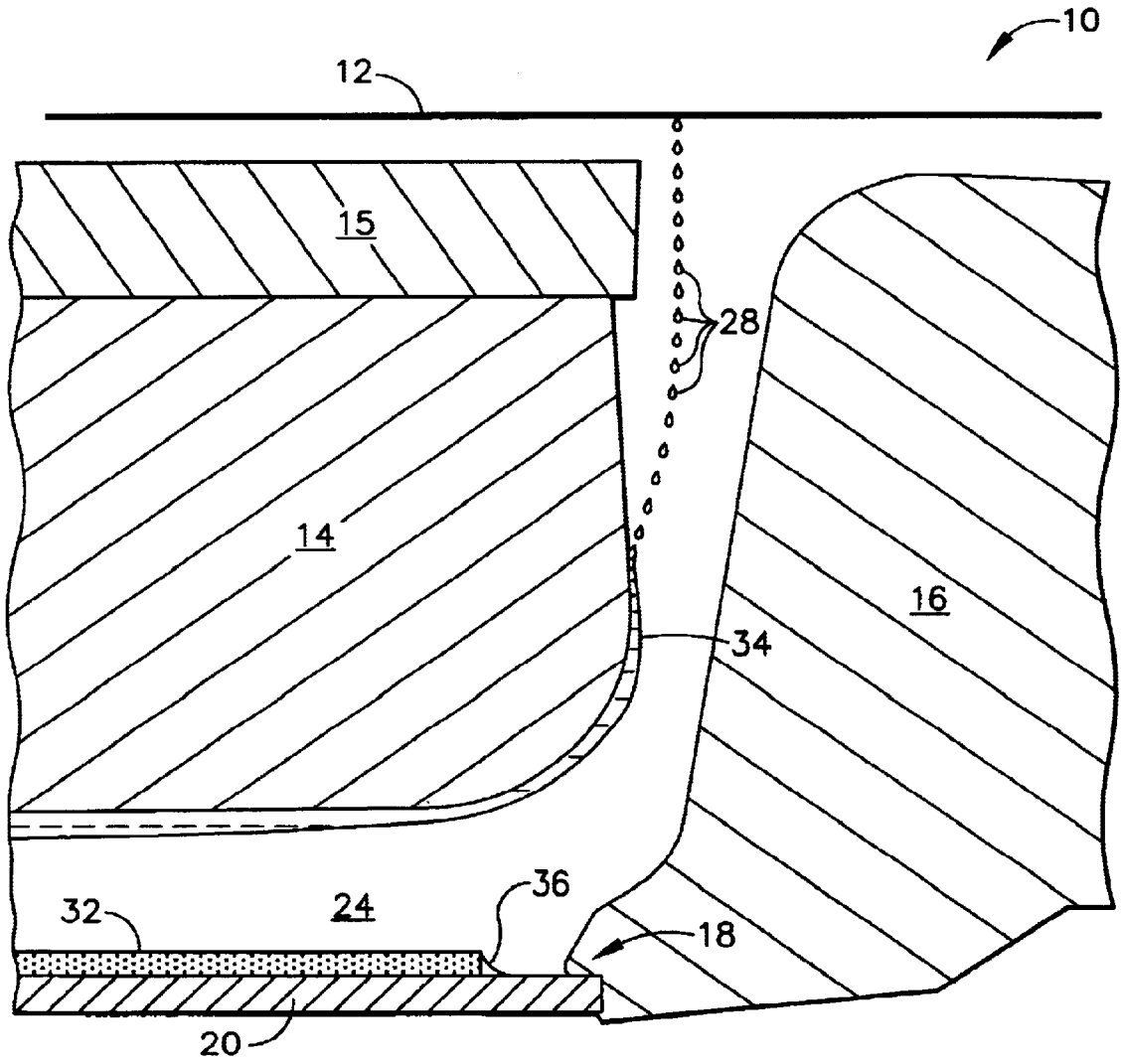
FIG. 3 illustrates the current invention, with charged ink droplets diverted by the eyelid to flow around the radius of the catcher into the catcher throat, over and through a wicking means of the present invention.

In accordance with the present invention, novel use of a wicking means in the fluid channel of the catcher is proposed to improve catcher operation. As illustrated in FIG. 3, a porous, ink compatible material 32 is placed on the bottom surface of the fluid channel. In one embodiment, this wicking means comprises a stainless steel mesh screen 32. During the startup sequence, ink drops are jetted and initially left uncharged to strike the eyelid. The ink is then diverted by the eyelid into the fluid channel. This ink flows primarily along the bottom of the fluid channel, flowing freely over the wicking means 32, and is removed through the outlet port (not shown) of the fluid channel. During the startup sequence, the charge voltage is turned on to deflect the ink drops. As shown in FIG. 3, the ink drops strike the face of the catcher and flow down the face into fluid channel 24. This ink flows primarily along the upper surface of the fluid channel 24 and is removed through the outlet port of the catcher. As observed in the prior art, this transition of flow from the lower surface of the catcher fluid channel to the upper surface can result in some residual ink being left on the lower surface of the fluid channel. The wicking means 32 on the catcher plate serves to draw the residual ink back away from the seal 18 between the eyelid 16 and the catcher plate 20. By drawing the residual ink away from the eyelid seal 18, the screen eliminates the problem seen with the prior art of dripping from the eyelid and catcher when the eyelid is opened.

With the wicking means on the bottom surface of the catcher flow channel, the vacuum in the fluid channel supplied by the fluid system (not shown) is able to remove excess fluid from the wicking means. Therefore, the wicking means will not become saturated with fluid to the point that it cannot serve to draw fluid back from the eyelid seal region.

When the wicking means of the present invention comprises a porous material, the excess ink fluid is wicked away from the front portion of this bottom surface, as indicated by wicked ink 36. One preferred embodiment for the wicking means 32 is a porous stainless steel screen. Although screen means are present in the prior art, the position and function of the wicking screen herein are quite different from that of catcher screens described, for example, in U.S. Pat. No. 5,105,205, and U.S. Pat. No. 5,469,202. In the present invention, the wicking means 32, is positioned to be on or integral with the bottom surface of the catcher flow channel, but does not bridge the gap to the upper surface of the fluid channel. This serves to allow for unobstructed flow of ink 34 into the fluid channel 24. In the prior art, screen means have been positioned to bridge the entire entrance to the fluid channel, with the intent of obtaining uniform ink removal across the width of the fluid channel by producing a uniform pressure drop at entrance to the fluid channel of sufficient magnitude to overwhelm any pressure drop variations across the fluid channel.

In the present invention, the purpose of the wicking means of the present invention is to eliminate excess fluid at the eyelid seal as a result of its wicking characteristics, rather than to provide uniform ink removal across the width of the flow channel as a result of it flow impedance characteristics. Hence, the wicking means 32 can be a screen material, as discussed above. A stainless steel mesh wire screen, of suitable wire diameter preferably between 0.008 and 0.016 inches, can advantageously wick ink away from the bottom surface of the fluid channel, particularly in the area of the eyelid seal. This stainless steel mesh screen may by cut by any suitable means, including, for example, by laser cutting. The screen is then bonded to the catcher plate prior to attaching the catcher plate to the catcher. One preferred means for bonding the screen to the catcher plate is by micro-spot welding. This process does not degrade the capillary action of the screen, as can often occur with a gluing process where the adhesive can fill the pores of the screen.

Alternatively, other thin wicking layers such as hydrophilic, porous materials can suitably wick away excess ink. Materials having morphologies similar to that of open cell foams can also function as suitable wicking means in accordance with the present invention. The wicking material can be other suitable porous pads, and can comprise layers of wicking materials, or a single pad or screen. Chemical machining methods, such as are described and claimed in U.S. Pat. No. 6,187,212, totally incorporated herein by reference, for the fabrication of the catcher fluid channels, might also be employed to fabricate fine capillary channels directly unto the upper surface of the catcher plate to form wicking means.

Pressure drops at the entrance to the catcher fluid channel are known in the art to excessively impede the removal of ink during printhead startup sequences. This can result in a failure during the printhead startup. Therefore, it is an advantage of the present invention over prior art uses of screens in the catcher fluid channel, that there is no deleterious pressure drop introduced by the wicking means at the entrance of the fluid channel.

The wicking means 32 of the present invention introduces a "step up" or bump on the catch plate surface. It has been found in the course of developing the present invention that such a bump or step up on the bottom surface of the fluid channel offers an unexpected benefit. In normal operation of the printhead, some air is ingested into the catcher fluid channel in addition to the ink. Under certain operating conditions, the process of ingesting air can make the air-ink interface in the catcher fluid channel unstable. As a result, some ink drops can be spit or expelled out of the fluid cavity from the unstable air-ink interface. It has been found that the step up present at the back edge 36 of the wicking means affects the air-ink interface such that the spitting from the fluid channel is eliminated. The elimination of the spitting problem is a result of the step at the back of the screen rather than due to the wicking characteristics of the screen. This was determined by fabricating a bump or step up onto the top surface of the catcher plate where the bump had no wicking tendencies. It proved to be sufficient to eliminate the spitting from the fluid channel. The non-wicking bump, however, increased the problem of residual ink on the catcher plate at the eyelid seal. The preferred solution to the spitting problem is to employ the step in the bottom wall of the fluid channel in combination with wicking means in front (the eyelid side of the step) to deal with the ink left at the eyelid seal.

It will be obvious to those skilled in the art that numerous materials and designs can satisfy these requirements, and provide the ink elimination solution, so long as the means or material is properly situated in an area at the bottom surface of the fluid channel in close proximity to the eyelid seal, to prevent spitting from the fluid channel and provide the wicking feature.

Having described the invention in detail and by reference to the preferred embodiment thereof, it will be apparent that other modifications and variations are possible without departing from the scope of the invention defined in the appended claims.

What is claimed is:

1. In an inkjet printer having a catcher and eyelid seal for sealing against the catcher during startup and shutdown, a method for removing excess ink from a fluid channel of the catcher having an associated catcher plate, in an area of the eyelid seal, the method comprising the steps of:

providing a wicking means; and positioning the wicking means in an area at a bottom surface of the fluid channel, without bridging a height of the fluid channel, above the catcher plate, and in close proximity to the eyelid seal, while maintaining a consistent pressure at an entrance to the fluid channel.

2. A method as claimed in claim 1 wherein the wicking means comprises a porous and ink compatible material.

3. A method as claimed in claim 2 wherein the porous and ink compatible material comprises a hydrophilic material.

4. A method as claimed in claim 2 wherein the porous and ink compatible material comprises a stainless steel mesh wire screen.

5. A method as claimed in claim 3 wherein the stainless steel mesh wire screen comprises a screen having a wire diameter in the range of 0.0008 to 0.0016.

6. A method as claimed in claim 1 wherein the step of positioning the wicking means further comprises the step of maintaining positioning of the wicking means by spot welding the wicking means to the catcher plate.

7. A method as claimed in claim 1 wherein the wicking means comprises a plurality of capillaries etched into a surface of the catcher plate within the fluid channel.

8. A wicking means for removing excess ink from a fluid channel of a printhead having an associated catcher plate, in an area of an eyelid seal, the wicking means comprising a means for creating a non-smooth surface in an area at a bottom surface of the fluid channel, but without bridging a height of the fluid channel, above the catcher plate, and in close proximity to the eyelid seal, while maintaining a consistent pressure at an entrance to the fluid channel.

9. A wicking means as claimed in claim 8 wherein the porous and ink compatible material comprises a stainless steel mesh wire screen.

10. A wicking means as claimed in claim 9 wherein the stainless steel mesh wire screen comprises a screen having a wire diameter in the range of 0.0008 to 0.0016.

11. A wicking means as claimed in claim 9 wherein the stainless steel mesh wire screen is attached to the bottom surface of the fluid channel by welding means.

12. A wicking means as claimed in claim 8 wherein the porous and ink compatible material comprises a hydrophilic material.

13. A wicking means as claimed in claim 8 wherein the wicking means comprises a plurality of capillaries etched into the surface of the catcher plate that forms the wall of the fluid channel.

14. An improved fluid channel for the catcher of an inkjet printhead having associated eyelid, the improvement comprising:

a catcher plate which forms a lower wall of the fluid channel and against which the eyelid seals;

wicking means on an upper surface of the catcher plate in close proximity to the eyelid seal for wicking ink away from region of the eyelid seal, said wicking means not bridging a height of the fluid channel, above the catcher plate.

15. An improved fluid channel as claimed in 14 further comprising a step in a bottom of the fluid channel for inhibiting expulsion of ink drops from the fluid channel.

16. An improved fluid channel as claimed in claim 15 wherein the step in the fluid channel comprises an edge of the wicking means attached to the upper surface of the catcher plate.

17. An improved fluid channel as claimed in claim 14 wherein the wicking means comprises a screen attached to the upper surface of the catcher plate.

* * * * *